US007819628B2

(12) United States Patent
Dervaux et al.

(10) Patent No.: US 7,819,628 B2
(45) Date of Patent: Oct. 26, 2010

(54) ASSEMBLY COMPRISED OF A VANE AND OF A COOLING LINER, TURBOMACHINE NOZZLE GUIDE VANES ASSEMBLY COMPRISING THIS ASSEMBLY, TURBOMACHINE AND METHOD OF FITTING AND OF REPAIRING THIS ASSEMBLY

(75) Inventors: Alexandre Nicolas Dervaux, Paris (FR); Olivier Jean Daniel Baumas, Vert Saint Denis (FR); Jean-Luc Bacha, Paris (FR)

(73) Assignee: SNECMA, Paris (FR)

( * ) Notice: Subject to any disclaimer, the term of this patent is extended or adjusted under 35 U.S.C. 154(b) by 707 days.

(21) Appl. No.: 11/692,677

(22) Filed: Mar. 28, 2007

(65) Prior Publication Data

US 2007/0231150 A1 Oct. 4, 2007

(30) Foreign Application Priority Data

Mar. 29, 2006 (FR) ..... 06 02716

(51) Int. Cl.
*F01D 5/18* (2006.01)

(52) U.S. Cl. ..... 416/96 A; 415/115

(58) Field of Classification Search ..... 415/115, 415/116; 416/90 R, 97 A, 96 A
See application file for complete search history.

(56) References Cited

U.S. PATENT DOCUMENTS

| | | | | |
|---|---|---|---|---|
| 5,145,315 | A * | 9/1992 | North et al. | 415/115 |
| 5,630,700 | A | 5/1997 | Olsen et al. | |
| 6,561,757 | B2 * | 5/2003 | Burdgick et al. | 415/115 |
| 6,874,988 | B2 * | 4/2005 | Tiemann | 415/115 |

FOREIGN PATENT DOCUMENTS

| | | |
|---|---|---|
| BE | 685 320 | 1/1967 |
| EP | 1 496 205 A1 | 1/2005 |
| EP | 1 544 414 A1 | 6/2005 |
| EP | 1 626 162 A1 | 2/2006 |
| FR | 2 094 033 | 2/1972 |
| FR | 2 205 097 | 5/1974 |

* cited by examiner

*Primary Examiner*—Edward Look
*Assistant Examiner*—Dwayne J White
(74) *Attorney, Agent, or Firm*—Oblon, Spivak, McClelland, Maier & Neustadt, L.L.P.

(57) ABSTRACT

An assembly includes a vane and a cooling liner for cooling the vane, the vane having a central cavity with at least one first opening into which the liner extends, the liner having a flange fixed to the rim of the opening. This assembly includes, near the flange, a peripheral insert inserted between the wall of the liner and the wall of the opening.

12 Claims, 2 Drawing Sheets

ASSEMBLY COMPRISED OF A VANE AND OF A COOLING LINER, TURBOMACHINE NOZZLE GUIDE VANES ASSEMBLY COMPRISING THIS ASSEMBLY, TURBOMACHINE AND METHOD OF FITTING AND OF REPAIRING THIS ASSEMBLY

BACKGROUND OF THE INVENTION AND DESCRIPTION OF THE PRIOR ART

The invention relates to an assembly comprised of a vane and of a cooling liner for cooling the vane, in a turbomachine nozzle guide vanes assembly.

A turbomachine comprises rotor stages—compressor and/or turbine rotor stages—separated by nozzle guide vanes assemblies. The latter comprise a plurality of fixed vanes intended to guide the streams of gas. The fixed vanes extend, in the path of the gases, between an outer shroud and an inner shroud. Because of the temperature of the gases passing through them, particularly in the nozzle guide vanes assemblies separating turbine stages, the vanes are subjected to very severe operating conditions; it is therefore necessary to cool them, generally by forced convection or alternatively by the impact of air, within the vanes.

For air impact cooling it is possible to use multiperforated longitudinal liners. These liners are generally made of a heat-resistant alloy, for example one based on chromium (Cr), cobalt (Co) and nickel (Ni). A liner such as this is slid longitudinally into the cavity of a vane. It is supplied with cooling air at the outer shroud. Because of the pressure difference there is between the interior cavity of the liner and the cavity formed between the liner and the vane, some of the air is propelled, via the perforations in the liner, against the internal wall of the vane, thus cooling it. This air is then removed, along the trailing edge of the vane, by calibrated perforations, into the gas path. The remainder of the air is removed through the inner shroud to other parts of the engine that require cooling, such as the turbine disk or the bearings.

The cavity in the vane forms two openings in the inner and outer platforms. The liner is generally fixed, on the outer side, to the wall of the outer opening, by brazing or welding, for example. This then yields a kind of brazed guideway connection. The liner is also guided, at its other end portion, in the inner opening, the wall of which forms a guideway for this purpose and makes it possible to compensate for differential expansions between the liner and the vane.

According to an advantageous configuration, the liner comprises, on its outer side, a flange, brazed to the nozzle guide vanes assembly. A flange sleeve is known from document US 2002/0028133. A flanged liner displays various advantages over liners in which the outer portion is brazed to a guideway: it allows the liner to be fitted very easily in the vane, with determined radial positioning, and the brazing of the flange to the nozzle guide vanes assembly is easy to perform and can be visually checked.

It is essential to ensure a good seal between the liner and the vane at the flange. This is because were sealing not achieved satisfactorily, leaks would occur in one direction or the other each being to detrimental effect. Thus, if the pressure on the outer side of the outer shroud of the nozzle guide vanes assembly is greater than the pressure in the cavity formed between the liner and the vane, air will enter the latter cavity; this causes an increase in the pressure on the outside of the liner which means that the air has less of a tendency to be propelled from the inside of the liner against the vane and vane cooling will therefore suffer. Conversely, if the pressure in the cavity between the liner and the vane is higher than the pressure on the outer side of the outer shroud of the nozzle guide vanes assembly then the air used to cool the vane and which has therefore heated up, will escape from this latter cavity and has a detrimental effect on the cooling, afforded by other means, of the outer side of the nozzle guide vanes assembly. The above problems could be partially alleviated by increasing the volume of the cooling flow in this region but increasing the volume in one location means reducing it somewhere else.

None of these situations is satisfactory and it is necessary to have a satisfactory sealed connection at the flange.

Such a connection may be obtained by brazing. However, even though such a brazed joint can be visually checked on the flange, there is still a risk of incomplete or defective brazing, leaving the way open for possible air leaks.

SUMMARY OF THE INVENTION

The present invention is aimed at proposing an assembly comprised of a vane and of a flanged cooling liner for cooling the vane, in which assembly the sealing of the fastening at the flange is ensured.

Thus, the invention relates to an assembly comprised of a vane and of a cooling liner for cooling the vane, in this instance, in a turbomachine nozzle guide vanes assembly, the vane comprising a central cavity with at least one first opening into which the liner extends, the liner comprising a flange fixed to the rim of the opening, which assembly comprises, near the flange, a peripheral insert inserted between the wall of the liner and the wall of the opening.

Such an insert creates a pressure drop. A pressure drop must be understood to mean not only a conventional pressure drop created by a narrowing of the cross section for the passage of a flow or by a baffle, but also a pressure drop (an infinite one) created by an airtight seal.

By virtue of the combination of a flange fixed to the rim and of an insert near this flange, the air does not leak—at least any leaks there might be are insignificant—and any omission in the brazing is not a problem. Specifically, since the flange is fixed, any air leaks there might be could leak only through a small clearance between the flange and the rim. Now, such leaks through a small gap cannot occur, in either direction, because of the insert which creates a pressure drop.

In solving a specific problem, the Applicant Company also discovered that it was possible to considerably simplify the fitting of the assembly. Specifically, the presence of an insert near the flange has a highly effective effect on air leaks, which means that there is no longer any need to braze the flange to the nozzle guide vanes assembly perfectly. It is therefore possible simply to fix the liner to the vane by spot welding between the flange and the rim, leaks being avoided by virtue of the insert. The time and cost savings are considerable by comparison with brazing around the entire periphery of the flange.

The insert may act as a baffle and/or as a seal.

Preferably, with the central cavity forming a second opening, the liner comprises an end portion at the opposite end to the flange, which portion is guided in the second opening, the wall of which forms a guideway for that purpose.

Advantageously in this case, there is a clearance between the liner and the wall of the first opening.

According to a first particular embodiment, the insert comprises a peripheral strip forming a baffle.

According to a second particular embodiment, the insert comprises an elastic leaf.

According to a third particular embodiment, the insert comprises a peripheral spring.

The invention also relates to a turbomachine nozzle guide vanes assembly comprising a plurality of assemblies as set out hereinabove, and to a turbomachine comprising such a nozzle guide vanes assembly.

The invention further relates to a simplified method, as set out hereinbelow, of fitting a cooling liner in a turbomachine nozzle guide vanes assembly hollow vane to form the assembly of the invention, the vane comprising a central cavity with at least one first opening and the liner comprising a flange, in which method:

- the liner is inserted in the cavity of the vane, via the first opening, so as to place a peripheral insert between the wall of the liner and the wall of the first opening, and
- the flange is spot welded to the rim.

By virtue of the use of the insert of the invention, the use of a flanged line can be implemented on an industrial scale, with control over the risks of air leaks. It is thus possible, when repairing a nozzle guide vanes assembly and when repairing the assembly of the invention, when removing and refitting the liner with respect to the vane, to implement a method in which:

- the flange of the liner is ground down as far as the rim without grinding away the insert,
- the liner is removed from the central body of the vane, via the first opening,
- a new flange is attached to the liner,
- the liner, with the new flange, is inserted in the cavity of the vane, via the first opening, so as to position the peripheral insert between the wall of the liner and the wall of the first opening, and
- the flange is fixed to the rim.

Such a method has the advantage of the simplicity with which it can be implemented.

It will be noted that the invention is particularly well suited to an assembly in which the liner is open at both ends, the end portion at the opposite end to the flange being guided in an opening, the wall of which forms a guideway, but it goes without saying that the invention can also apply to an assembly in which the liner is open only at the flanged end, without necessarily being guided in a guideway at its other end.

BRIEF DESCRIPTION OF THE DRAWINGS

The invention will be better understood with the aid of the following description of the preferred embodiments of the invention, with reference to the attached plates in which.

DESCRIPTION OF THE PREFERRED EMBODIMENTS

Figure 1:
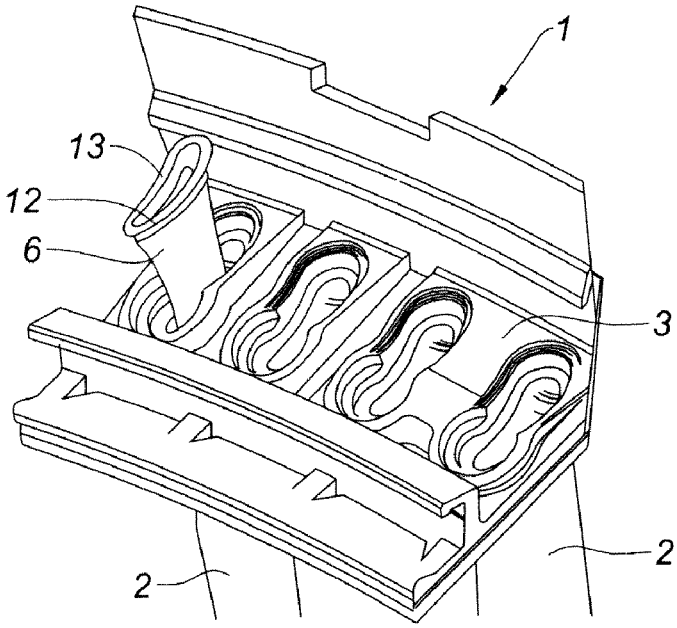
FIG. 1 depicts a schematic perspective view of a portion of the nozzle guide vanes assembly of the invention.
Figure 2:
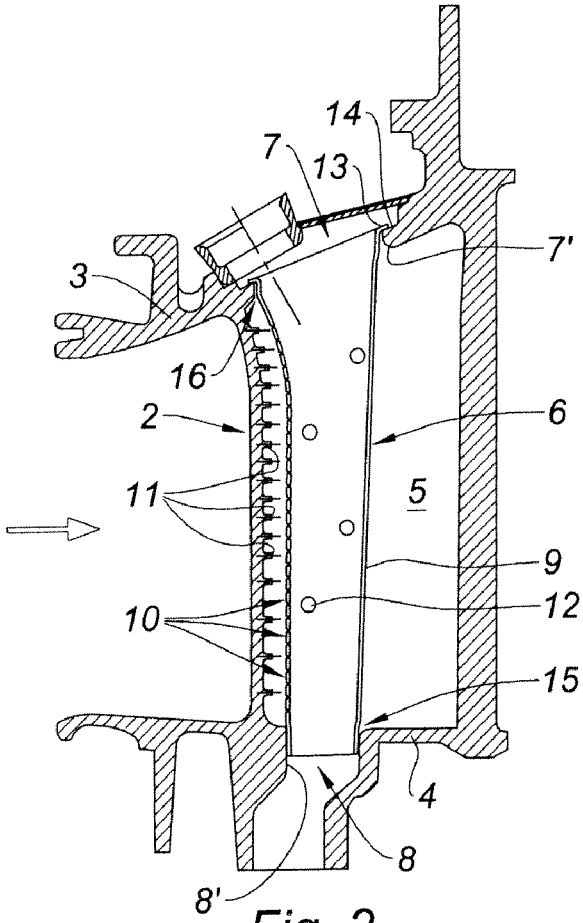
FIG. 2 depicts a schematic sectioned view of the assembly of the invention.

With reference to FIGS. 1 and 2, a nozzle guide vanes assembly 1 comprises a plurality of fixed vanes 2, forming a cascade straightening the stream of air passing through the engine gas passage. The arrow in FIG. 2 represents the direction in which the gas flows, from upstream to downstream. This passage is delimited by an outer shroud 3 and an inner shroud 4, supporting the vanes 2.

Each vane 2 is hollow and comprises a central cavity 5 within which a cooling liner 6 is inserted. In FIG. 1, the cooling liner 6 farthest to the left has been depicted partially extracted from the cavity 5 of its accommodating vane 2 in order to make it easier to understand the shape of the various elements. One particular assembly of a vane 2 and of a liner 6 will be described hereinafter, it being understood that all the assemblies 2, 6 of the nozzle guide vanes assembly 1 are similar in their structure.

The cavity 5 of the vane 2 forms an outer opening 7 and an inner opening 8 in the outer 3 and inner 4 shrouds of the nozzle guide vanes assembly respectively. In order to be fitted into the vane 2, the liner 6 is inserted via the outer opening 7.

The liner 6 comprises a hollow body 9 pierced, in this instance on the upstream side, with a plurality of orifices 10 via which air supplied to the body 9 of the liner 6 at a supply pipe 11 situated near the outer opening 7 of the vane 2 is propelled against the internal wall of the vane 2. In this particular instance, the internal wall of the vane 2 comprises, facing these orifices 10, a plurality of fins 11 forming disturbances for better cooling of the vane 2, in a known manner. The liner 6 also comprises, on its outer surface, a plurality of bosses 12—also depicted schematically in FIG. 2, although the latter figure is in section—the function of which is to allow the liner 6 to be positioned in the cavity 5 of the vane 2.

The liner 6 comprises, at its outer end, a flange 13. This flange 13 here is obtained by forming the sheet of which the liner 6 is made. It could equally well be attached to the latter. The flange 13 is designed to bear against the rim 14 formed by the nozzle guide vanes assembly around the outer opening 7 formed by the cavity 5 in the vane 2. The flange 13 is fixed to this rim 14 by brazing or welding as will be detailed later on.

At its inner end, the liner 6 comprises an end portion 15, in the continuation of its body 9, inserted in the inner opening 8 formed by the vane 2, the wall 8' of which forms a guideway to guide this end portion 15 in a known manner. Because of this freedom of movement, the differences in thermal expansion between the vane 2 and the liner 6 can be absorbed.

The assembly comprised of the vane 2 and of the liner 6 also comprises, near the flange 13, an insert 16. The function of the insert 16 is to create a pressure drop near the flange 13 to prevent, or at least limit, air leaks, in both directions. This insert 16 is peripheral around the liner 6. It may be secured either to the liner 6 or to the nozzle guide vanes assembly 1. It lies near the flange 13, that is to say that it lies in a region in which its effects may be combined with those of the flange 13. In other words, the pressure drops generated by the insert 16 need to be great enough to prevent air leaks through any gaps there may be between the flange 13 and the rim 14. In this particular instance, the insert 16 lies, under the flange 13, at the wall 7' of the outer opening 7, which is extended by the rim 14 to which the flange 13 is fixed. Three particular embodiments of the insert will now be described in relation to FIGS. 3 to 5. In these three embodiments, the insert 16 is depicted secured to the liner 6, but it goes without saying that those skilled in the art will have no difficulty in carrying embodiment details over to an insert 16 secured to the wall 7' of the outer opening 7 formed by the vane 2. In the three figures, the insert is denoted by the same reference 16.

Figure 3:
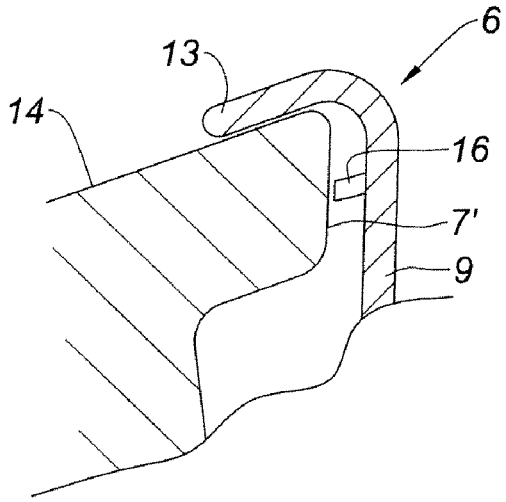
FIG. 3 depicts a schematic sectioned view of the insert according to a first embodiment of the assembly of the invention.

With reference to FIG. 3, the insert 16 comprises, according to a first embodiment, a peripheral strip 16 or peripheral leaf fixed around the liner 6, under the flange 13. This metal strip 16 is designed to extend radially over a distance shorter than the distance separating the wall of the liner 6 from the wall 7' of the outer opening 7 at this point, preferably lying flush with the latter. The expression "radially" is to be understood as meaning radially with respect to the overall axis of the liner, that is to say with respect to its longitudinal direction between the flange 13 and the end portion 15. The pressure drop thus created is enough to prevent or satisfactorily limit leaks between the flange 13 and the rim 14. In this embodiment, the insert forms a baffle, against air flow, around the entire periphery of the liner 6.

Figure 4:
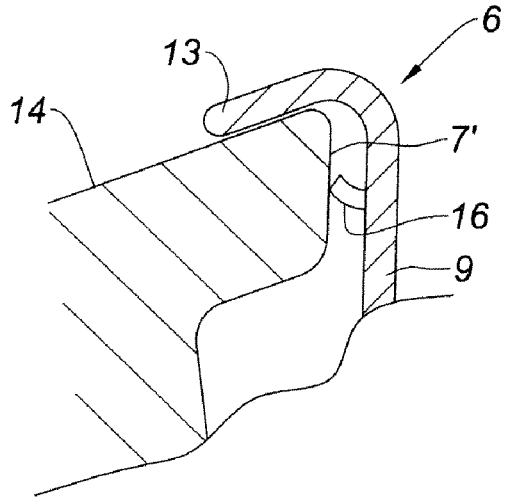
FIG. 4 depicts a schematic sectioned view of the insert according to a second embodiment of the assembly of the invention.

With reference to FIG. 4, the insert 16 comprises, according to a second embodiment, a peripheral leaf 16 that exhibits a certain elasticity. This metal leaf 16 has a radial dimension which may perhaps be greater than the average distance separating the wall of the liner 6 from the wall 7' of the outer opening 7 at this point. When the liner 6 is introduced into the opening 7, there is no harm in the liner 6 not being perfectly centered with respect to the opening 7. The leaf 16 bears against the wall portions 7' of the opening 7 to which the liner 6 is closest and curves elastically outward as the liner 6 is introduced, thus compensating for the clearance. Provision may incidentally be made for the dimension of the leaf 16 to be such that the leaf comes into contact with the wall 7' of the opening 7 over the entire periphery of the liner 6, thus forming a seal.

By virtue of this embodiment it is possible to leave a clearance between the liner 6 and the wall 7' of the outer opening 7. Such a clearance makes it easier to fit the liner 6. As it is introduced into the vane 2, the liner 6 is guided, at its end portion 15, in the guideway 8 situated on the internal end of the vane 2. This guidance is performed freely because it is not impeded by any misalignment of the inner opening 8 and of the outer opening 7 because of the clearance there is at the latter end. Such a clearance is not prejudicial to fitting because it is compensated by the elasticity of the leaf 16. Thus, the leaf 16 can enter the opening 7 and perform its function of limiting leaks. By virtue of the leaf 16, the presence of a clearance does not entail leaks; the clearance and the advantages it implies are therefore permitted by the presence of the leaf 16.

In this embodiment, the insert 16 may either act as a baffle or act as a seal or act as both depending on whether it touches the wall 7' of the outer opening 7 (sealing function) or does not touch it (baffle function). In both instances, it causes a pressure drop in its locality. When it performs both functions, the sealing element 16 acts, over certain portions—where the leaf 16 is not in contact with the wall 7' of the opening 7—as a baffle and, over other portions—where the leaf 16 is in contact with the wall 7' of the opening 7, as a seal.

Figure 5:
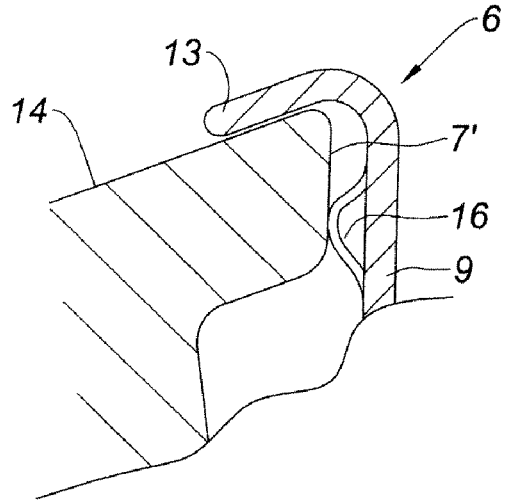
FIG. 5 depicts a schematic sectioned view of the insert according to a third embodiment of the assembly of the invention.

With reference to FIG. 5, the insert 16 comprises, according to a third embodiment, a peripheral spring 16. This spring 16, which is made of metal, comprises a leaf the edges of which are fixed to the surface of the liner 6, the leaf exhibiting a flared U-shaped cross section between the two fixed edges. As before, such a spring-forming element 16 is able to compensate for any clearance there might be at the outer opening 7 and may, depending on the region of the liner 6, act as a seal and/or as a baffle according to whether or not the spring 16 is in contact with the wall 7' of the opening 7.

The insert has been presented according to three preferred embodiments but it goes without saying that it is possible to imagine other structures provided they extend between the wall of the liner 6 and that of the opening 7 to create a pressure drop. It is also possible to combine several inserts and create a kind of labyrinth seal.

By virtue of the insert 16, air leaks at the flange 13 are, if not completely avoided, at least greatly limited. The flange 13 may be fixed to rim 14 by brazing. In such a case, any absence of braze material is not prohibitive because the insert prevents or limits leaks. The use of an insert also allows the use of a special method for fitting the liner 6 in the vane 2, in which method:

- the liner 6 is inserted into the cavity 5 of the vane 2 via the outer opening 7, and
- the flange 13 is spot welded to the rim 14.

Such a method of fitting is very quick and inexpensive. This is because instead of being brazed around its entire circumference, the flange 13 is simply welded at a number of points (the term generally employed is "tacking"). The assembly is operationally viable because the spot welds are enough to hold the liner 6 on the vane 2 whereas the insert 16 provides sealing or at least limits leaks at the flange 13. It will be noted that the spot-welded attachment between the liner 6 and the rim 14 is strong enough because the mechanical stresses at a nozzle guide vanes assembly liner are not excessively high.

Thus, the attachment method can be freely adapted to suit the mechanical stresses, on the one hand, and constraints on time and costs of fitting on the other. This freedom is conferred by the presence of an insert between the wall of the liner 6 and the wall 7' of the opening 7, making it possible to choose between brazing and spot welding.

If the nozzle guide vanes assembly 1 needs to be repaired then it is possible, for each assembly comprised of a vane 2 and of a liner 6, to employ a repair method in which:

- the flange 13 of the liner 6 is ground down as far as the rim 14 without grinding away the insert 16,
- the liner 6 is removed from the central body 5 of the vane 2, via the opening 7,
- a new flange is attached to the liner 6,
- the liner 6, with the new flange, is inserted in the cavity 5 of the vane 2, via the outer opening 7, so as to position the peripheral insert 16 between the wall of the liner 6 and the wall 7' of the opening 7, and
- the flange 13 is fixed to the rim 14.

The step of grinding down the flange 13 may be employed by machining, or preferably by routing using an electro discharge machine (this type of routing being well known to those skilled in the art as "EDM routing"). The routing that needs to be done is very quickly performed because all that is required is for the flange 13 to be routed, this flange in general not being very thick. It is simple thereafter, once the liner 6 has been removed from the central cavity 5 of the vane 2, to attach a flange to the body 9 of the liner 6, for example by welding, to recreate a new liner. The latter can then be inserted once again in to the central cavity 5 of the vane 2.

The invention claimed is:

1. An assembly comprising:

a vane;

a cooling liner for cooling the vane, the vane comprising a central cavity with at least one first opening into which the liner extends, the liner comprising a flange fixed to the rim of the opening, and near the flange but not in contact with said flange, a peripheral insert inserted between the wall of the liner and the wall of the opening, wherein the insert comprises a peripheral strip forming a baffle.

2. The assembly as claimed in claim 1, wherein the insert creates a pressure drop.

3. The assembly as claimed in claim 1, wherein, with the central cavity forming a second opening, the liner comprises an end portion at the opposite end to the flange, said end portion being guided in the second opening, the wall of which forms a guideway.

4. The assembly as claimed in claim 3, wherein a clearance is present between the liner and the wall of the first opening.

5. The assembly as claimed in claim 1, wherein the insert comprises an elastic leaf.

6. The assembly as claimed in claim 1, wherein the insert comprises a peripheral spring.

7. The assembly as claimed in claim 1, wherein the flange is spot welded to the rim so that said flange is fixed to said rim only at a number of points.

8. A turbomachine nozzle guide vanes assembly comprising a plurality of assemblies comprised of a vane and of a liner as claimed in claim 1.

9. A turbomachine comprising a nozzle guide vanes assembly as claimed in claim 8.

10. The assembly as claimed in claim 1, wherein said liner defines a plurality of cooling holes, and wherein said insert is located between said plurality and said flange such that no cooling hole is present between said insert and said flange.

11. A method for repairing an assembly including a vane and a cooling liner for cooling the vane, the vane comprising a central cavity with at least one first opening into which the liner extends, the liner comprising a flange fixed to the rim of the opening, said method comprising:

grinding the flange of the liner down as far as the rim without grinding away the insert, removing the liner from the central body of the vane, via the first opening, attaching a new flange to the liner, inserting the liner, with the new flange, in the cavity of the vane, via the first opening, so as to position the peripheral insert between the wall of the liner and the wall of the first opening, and fixing the flange to the rim.

12. An assembly comprising:

a vane;

a cooling liner for cooling the vane, the vane comprising a central cavity with at least one first opening into which the liner extends, the liner comprising a flange fixed to the rim of the opening, and near the flange but not in contact with said flange, a peripheral insert inserted between the wall of the liner and the wall of the opening, wherein said insert extends radially with respect to an axis of said liner over a distance that is shorter than a distance separating said liner from said wall of the opening.

* * * * *